US006564031B2

(12) United States Patent
Murata

(10) Patent No.: US 6,564,031 B2
(45) Date of Patent: May 13, 2003

(54) FIXING APPARATUS AND IMAGE FORMING APPARATUS

(75) Inventor: Hiroshi Murata, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/955,190

(22) Filed: Sep. 19, 2001

(65) Prior Publication Data

US 2003/0053829 A1 Mar. 20, 2003

(51) Int. Cl.[7] ..... G03G 15/20
(52) U.S. Cl. ..... 399/323
(58) Field of Search ..... 399/320, 322, 399/323, 328, 330, 331, 333, 397, 400; 219/216, 243, 469

(56) References Cited

U.S. PATENT DOCUMENTS 5,724,638 A * 3/1998 Isogai et al. ..... 399/333
6,345,169 B1 * 2/2002 Haneda et al. ..... 399/328
6,393,246 B2 * 5/2002 Tsujihara ..... 399/322

FOREIGN PATENT DOCUMENTS

JP 11-073056 3/1999
JP 2000-122461 4/2000

* cited by examiner

*Primary Examiner*—Hoan Tran
(74) *Attorney, Agent, or Firm*—Foley & Lardner

(57) ABSTRACT

A fixing apparatus includes a fixing device having a fixing roller and pressure applying roller set in pressure contact with the fixing roller and, by feeding a developing agent image-transferred medium past a nip between the fixing roller and the pressure applying roller, fixing the developing agent image to the medium and a separating device having a forward end set in abutting contact with an outer peripheral surface of the fixing roller and separating the medium which is fed past the nip from the fixing roller, in which the forward end of the separating device abuts against on outer periphery of the fixing roller in a range of a distance corresponding to ⅛ to ⅓ of a full outer periphery length of the fixing roller which is spaced from a center of the nip along the outer periphery of the fixing roller.

18 Claims, 2 Drawing Sheets

FIXING APPARATUS AND IMAGE FORMING APPARATUS

BACKGROUND OF THE INVENTION

1. Field of the Invention

The present invention relates to a fixing apparatus, within an image forming apparatus, for thermal fusion-pressing a to-be-fixed toner on a recording medium in a copying machine, printer, facsimile equipment, etc., and, by doing so, fixing the toner to the recording medium.

2. Description of the Related Art

This type of fixing apparatus has a fixing roller and pressure applying roller set in pressure contact with the fixing roller and, by feeding a toner-image-transferred recording medium past a nip between the fixing roller and the pressure-applying roller, the toner is thermally-fused to the recording medium and is fixed onto it.

However, a color image transferred onto the recording medium involves a greater toner quantity and is required to meet better color reproduction or light transmission in the case of the medium being an OHP and, therefore, a toner of lower fusion viscosity is used.

In this situation, the fused toner is liable to be deposited onto the surface of the fixing roller and tends to cause "offsetting".

Further, an added adhesion force acts between the toner and the fixing roller and it is difficult to separate the recording sheet from the fixing roller. This causes "wrapping" of the sheet onto the fixing roller.

In order to lower such an adhesion force between the fixing roller and the toner, a means is adopted, for example, for coating a silicone oil on the surface of the fixing roller.

In this case, however, an oil coating mechanism is required, thus necessitating oil refills, which increases the costs.

In the fixing apparatus for fixing a color image, the surface of the fixing roller is covered with a layer of rubber and, against the rubber layer of the fixing roller, a pressure applying roller made of metal is pushed with a nip set in an upwardly directed state, whereby the sheet passing through the nip is delivered in a downwardly directed state so that the sheet is separated and hence prevented from being "wrapped" onto the fixing roller.

If, however, the rubber layer is provided on the surface of the fixing roller, heat conduction from a heat source in the fixing roller is lowered and a longer warming-up time is required to reach a predetermined fixing temperature. In the color image forming apparatus, the reduction of the warming-up time is considered to be important from a standpoint of energy saving.

In a hard type of fixing roller having no rubber layer, a recording sheet is caused to be separated from the fixing roller with the use of a separating claw.

In the prior art, the separating claw is abutted against the fixing roller in the neighborhood of an exit side of the fixing nip and, since the sheet is separated at an abrupt angle, the scratching of an image by the separating claw is left as a mark and the fixing roller is injured and, as a result, a resultant image is lower in quality.

Where use is made of such a separating claw, the warming-up time of the fixing roller is fast but it is difficult to separate the recording sheet Properly. As a result, it is difficult to achieve a better trade-off between the separation of the recording sheet and a shortening in the warning-up time.

BRIEF SUMMARY OF THE INVENTION

The present invention is achieved with the above in view and is directed to a fixing apparatus and image forming apparatus which can achieve a trade-off between the separation of a medium and a shortening in a warming-up time.

A fixing apparatus of the present invention comprises a fixing device having a fixing roller and pressure applying roller set in pressure contact with the fixing roller and, by feeding a developing agent image-transferred medium past a nip between the fixing roller and the pressure applying roller, fixing the developing agent image to the medium and a separating device having a forward end set in abutting contact with an outer peripheral surface of the fixing roller and separating the medium which is fed past the nip from the fixing roller, wherein the forward end of the separating device abuts against the outer periphery of the fixing roller in a range of a distance corresponding to ⅛ to ⅓ of a full outer periphery length which is spaced from a center of the nip along the outer periphery of the fixing roller.

Further, an image forming apparatus of the present invention comprises an image carrier for carrying an electrostatic latent image, an image forming device for forming an electrostatic latent image on the image carrier, a plurality of developing devices for supplying developing agents of respective colors onto the electrostatic latent image formed by the image forming device to effect color development, a transferring device for transferring the developing agent image developed by the corresponding developing device, a fixing device having a fixing roller and pressure applying roller set in pressure contact with the fixing roller and, by feeding the color developing agent image-transferred medium past a nip between the fixing roller and the pressure applying roller, fixing the color developing agent image to the medium, and a separating device having a forward end abutting against an outer peripheral surface of the fixing roller to separate the medium which is fed past the nip from the fixing roller, wherein the forward end of the separating device abuts against the outer peripheral surface of the fixing roller in a range of a distance corresponding to a full outer periphery length of the fixing roller which is spaced from a center of the nip along the outer periphery of the fixing roller.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the present invention.

DETAILED DESCRIPTION OF THE INVENTION

The embodiments of the present invention will be described below with reference to the accompanying drawings.

Figure 1:
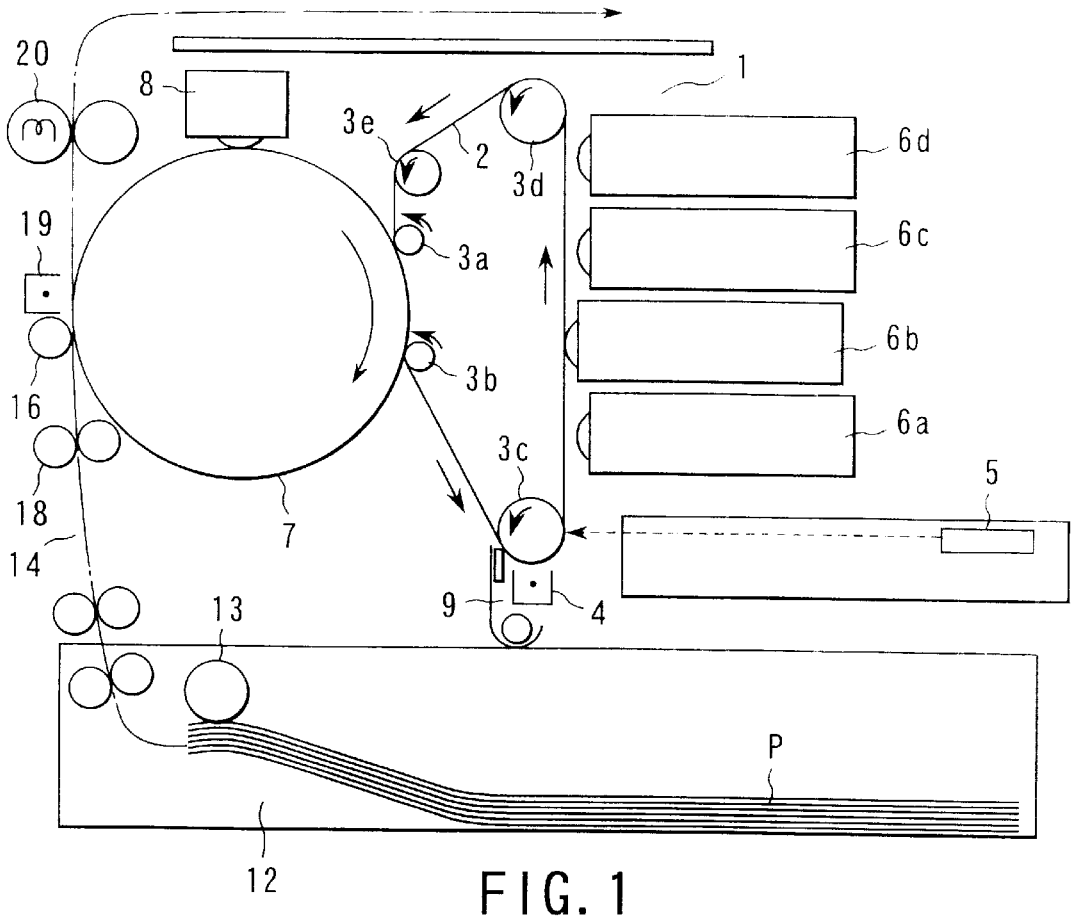
FIG. 1 is a schematic view showing a color electrophotographic copying apparatus according to one embodiment of the present invention.

FIG. 1 is a schematic view showing a color electrophotographic apparatus as an image forming apparatus according to one embodiment of the present invention.

This color electrophotographic apparatus includes an image forming section. The image forming section 1 has a photosensitive belt 2 serving as an image carrier. The photosensitive belt 2 is entrained around an array of first to fifth rollers 3*a* to 3*e* under a predetermined tension force along a direction indicated by arrows in FIG. 1.

Around the photosensitive belt 2 are arranged a charger unit 4 for charging the photosensitive belt 2 to a predetermined potential along the running direction, a light exposure device 5 acting as an image forming device for forming an electrostatic latent image on the charged photosensitive belt 2, and first to fourth developing devices 6*a* to 6*d*, each, for supplying a toner as a developing agent to the electrostatic latent image on the photosensitive belt 2 and developing the latent image to a visible image. Further, around the photosensitive belt 2, a rotatable intermediate transfer unit 7 for once retaining the toner image on the photosensitive belt 2 along the running direction and a cleaner unit 9 for eliminating the toner left on the photosensitive belt 2. An the upper side of the intermediate transfer unit a cleaner 8 is provided for cleaning the intermediate transfer unit. 7.

The photosensitive belt 2 is so set as to make an outer peripheral surface of the intermediate transfer unit 7 in an intimately contacted state at its portion stretched between first and second rollers 3*a* and 3*b* and is so set as to face developing devices 6*a* to 6*d* at its portion stretched between third and fourth rollers 3*c* and 3*d* with a given gap defined there.

It is to be noted that a drive motor, not shown, is connected to any one of the first to fifth rollers 3*a* to 3*e* and, by the rotation of the drive motor, the first to fifth rollers 3*a* to 3*e* are rotationally driven at a predetermined speed in the direction indicated by arrows.

Below the image forming section 1, a sheet cassette 12 is provided for storing sheets p of a predetermined size as a to-be-transferred medium and a paper supply roller 13 is provided for picking up sheets p one by one. Between the sheet cassette 12 and the intermediate transfer unit 7, a conveying path 14 is provided along a vertical direction to convey the sheet P toward the intermediate transfer unit 7. At the conveying path 14, a transfer roller 16 is provided as a transfer device in such a state as to face the intermediate transfer unit 7 to allow a toner image which is formed on the intermediate transfer medium 7 to be transferred to the sheet P.

On the stream side of the transfer roller 16 as viewed in the sheet conveying direction, aligning rollers 18 are provided. The aligning rollers 18 once stop the sheet P which is conveyed on the conveying system 14 and correct the inclination of the sheet P relative to the conveying direction to allow the leading edge of the sheet P to be aligned with the forward end of a toner image on the intermediate transfer unit 7.

On the down upstream side of the transfer roller 11 as viewed in the sheet conveying direction, a separating device 19 and fixing apparatus 20 are provided, the separating device 19 applying an AC charge for separating the toner image-transferred sheet P from the intermediate transfer unit and the fixing apparatus 20 fixing the toner image which is transferred to the sheet P to the sheet P.

An explanation will be made below about a full-color printing operation by the above-mentioned color electrophotographic apparatus.

First, the surface of a rotating photosensitive belt 2 is uniformly charged to a predetermined potential by the charging unit. Then, a light exposure corresponding to a yellow image is applied to the photosensitive belt 2 by the light exposure device 5 to form an electrostatic latent image. The electrostatic latent image is developed by being supplied with a yellow toner from the yellow developing device 6*a*. This developing agent image is transferred onto the intermediate transfer unit 7. After this transfer, the photosensitive belt 2 is set away from the intermediate transfer unit 7 and light-discharged by a discharger not shown.

On the other hand, toner left on the photosensitive drum 2 not transferred to the intermediate transfer unit 7 is cleaned by the cleaner unit 9. The toner removed by the cleaning operation is collected into a spent toner box, not shown. After this, the photosensitive belt 2 is recharged by the charging unit 4 and a light exposure corresponding to a magenta image is applied to the photosensitive belt 2 by the light exposure device 5 to form an electrostatic latent image. This electrostatic latent image is developed with a magenta toner by means of a magenta developing device 6*b*. This magenta toner image is transferred in a registering fashion on the yellow image on the intermediate transfer unit 7. The cyan image and black image are similarly handled in a registering fashion to allow an image to be formed in 4-color registering fashion.

After the formation of a resultant image, a sheet P is supplied into an area between the intermediate transfer unit 7 and the transfer roller 16 to allow a 4-color registered toner image to be secondarily transferred at a time to the sheet P. The thus toner image-transferred sheet P is separated from the intermediate transfer unit 7 by means of the separating charger 19. The separated sheet P is fed to the fixing apparatus 20 to obtain a fixed color image.

That toner left unprinted on the sheet P remains on the intermediate transfer unit 7 and is cleaned by the cleaner 8 which is brought into contact with the intermediate transfer unit 7 after the completion of the secondary transfer as set out above.

During a time period in which the above-mentioned 4-color registering image is formed onto the intermediate transfer unit 7, the cleaner 8 is set away from the intermediate transfer unit 7.

Figure 2:
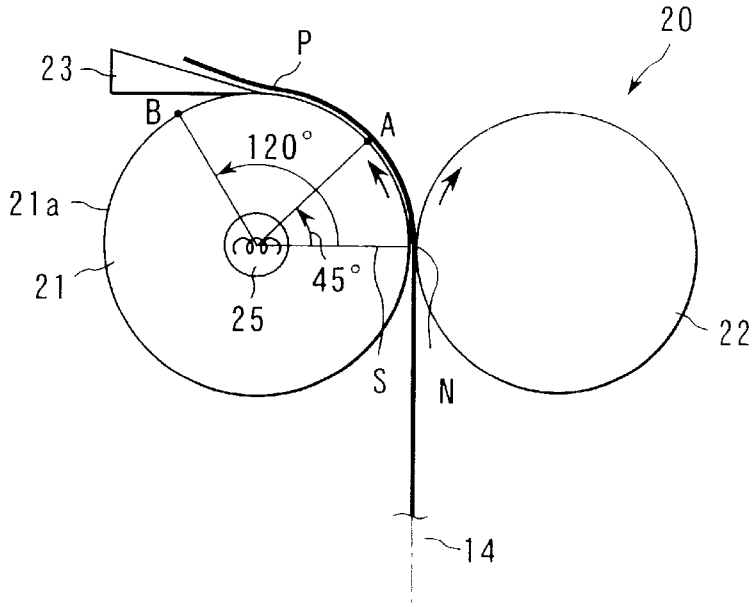
FIG. 2 is a schematic view showing a fixing apparatus in the color electrophotographic copying apparatus of FIG. 1.

FIG. 2 shows the fixing apparatus 20 as set out above.

The fixing apparatus 20 includes a fixing roller 21 and pressure applying roller 22 set in pressure contact with the fixing roller 21. The fixing roller 21 and pressure applying roller 22 are arranged in a symmetrical relation to the vertical conveying path 14. Within the fixing roller 21, a heater lamp 25 is provided as a heating source.

Against an upper surface side of the outer periphery of the fixing roller 21 a separating claw 23 is abutted at its forward end and serves as a separating device. The forward end of the separating claw 23 is abutted against the fixing roller 21 within a predetermined area at the upper surface side of the outer periphery of the fixing roller 21. That is, the forward end of the separating claw 23 is abutted against the outer peripheral surface of the fixing roller 21 within an area A to B spaced from the center of a "fixing nip N" by a distance corresponding to ⅛ to ⅓ of a full length of the outer periphery of the fixing roller 21 on a downstream side as viewed from a rotation direction of the fixing roller 21.

In this embodiment, the forward end of the separating claw 23 is abutted against a portion of the fixing roller 21 spaced from a center of the nip N by a distance corresponding to about ¼ of the full length of the outer periphery of the fixing roller 21, that is, by that distance spaced on a downstream side as viewed from a rotation direction of the fixing roller 21.

By thus spacing the sheet separating site by a predetermined distance from the center of the fixing nip N it is possible to made a sheet separation angle more lenient and to perform a sheet separation properly.

Further, a fluorine-based resin layer 21*a* is covered on the surface of the fixing roller 21 and, since the fluoride-base resin layer 21*a* is lower in heat conductivity than metal, it is easier to separate the sheet properly, while contacting with the fixing roller 21, due to a temperature between the roller surface and the toner image being somewhat lowered. This is probably due to the fact that, while heat is supplied by the heater lamp 25 from an inside of the fixing roller 21, a temperature gradient is created between the sheet P, toner and above-mentioned resin layer 21*a* on the roller surface 21 to allow the sheet to be easily separated.

The resin layer 21*a* covered on the surface of the fixing roller 21 provides better mold releasability relative to the toner as a first object and, according to the present invention, an advantage is also found from the heat conductivity of the resin layer 21*a*.

Further, a temperature difference producing effect is also easily obtained by maintaining the sheet in such a state not backed up by the pressure applying roller 22 for a predetermined time period. That is, it may be considered that, though in the prior art technique a sheet is separated just after leaving a fixing nip N, according to the present invention a predetermined distance is provided to allow the back surface side of the sheet to be somewhat cooled during a passage of time and hence a temperature between the fixing roller 21 and the surface of the toner image relating to the offset is lowered to ensure an easier sheet separation.

Spacing the sheet separating position from the center of the fixing nip N by a distance corresponding to ⅛ to ⅓ of the full length of the outer peripheral surface of the fixing roller along the outer peripheral surface is found advantageous for the releasability of the sheet from the standpoint of the temperature gradient and, in particular, spacing that portion by a distance corresponding to ¼ of the full length of the outer periphery of the fixing roller is found better.

Further, this specific arrangement is found particularly effective for the separation of the sheet in the case where the sheet is fed from below toward un upper side past the fixing nip N.

That is, in the case where a fixing roller and pressure applying roller are arranged one above the other and a sheet is fed into a fixing nip in a substantially horizontal relation, the sheet leaving the fixing nip is directed, under a gravity force, to be easily separable. In the case where, on the other hand, the sheet is fed from below toward an upper side past the fixing nip as in the present invention, it is difficult to separate the sheet under a gravity force but it is possible to maintain a better sheet separation by spacing a sheet separating position from the center of the fixing nip N by a predetermined distance along the outer peripheral surface of the fixing roller.

It is to be noted that, in the prior art, a separating claw is set at a position just at an exit of the fixing nip and, for a fixing roller, use is made of a fluorine-based material (PTFE) covered on the surface of the fixing roller.

Comparison is made below between the prior art fixing apparatus and the fixing apparatus of the present invention in the case where a solid image with a toner deposition amount of about 1.2 mg/cm$^2$ is fixed.

In the prior art technique, use is made of a fixing apparatus where a sheet P is fed from below toward an upper side and, in this case, a character image less in printing percentage present no problem but streaks are left by the separating claw as a mark on a "solid image" or there occurs a jamming of sheets.

In this embodiment, on the other hand, no streak mark occurs even on the solid image and a better condition is realized without involving any sheet jamming.

In the fixing apparatus of the present invention, if a sheet separating position is set near an exit side of the fixing nip, then a streak mark on the image as well as a sheet jamming, etc., is liable to occur as in the prior art.

If, on the other hand, a sheet separating position is set far away from the fixing nip, then a sheet leaving the fixing apparatus involves no proper alignment of its mage in a sheet discharging direction. Further, the sheet stays longer on the surface of the fixing roller, so that the warming-up of the fixing roller is delayed.

In connection with the separation of the sheet, a distance far the center of the fixing nip N to the forward end of the separating claw 23 was varied with its length as a reference relative to the outer peripheral distance of the fixing roller 21.

From this, a range over which the forward end of the separating claw 23 is spaced from the center of the fixing nip N by a distance corresponding to ⅛ to ⅓ of the full outer peripheral length of the fixing roller, that is, by that distance along a downstream side as viewed in the rotational direction of the fixing roller, has been found relatively better and a range over which a distance from the center of the fixing nip toward the forward end of the separating claw 23 is about ¼ of the full outer peripheral length of the fixing roller has been found particularly better.

Although, on the other hand, a means can be adopted to improve the releasability of the sheet by increasing an amount of wax as a mold releasing agent in a toner, if the wax is increased in the toner, a problem arises in a developing process.

That is, the use of more wax creates masses of the toner itself and adhesion of other materials to the toner and there is often the case where more mold releasing agent, such as the wax, should not be added to the toner from the standpoint of the developing process. According to the present invention, another advantage is obtained from the standpoint of this consideration.

In the prior art technique, use is made of, as the fixing roller, a metal roller thinly coated with the fluorine-based coating agent PTFE.

In the present embodiment, use is made of, as the fixing roller 21, a metal roller over which a 50 $\mu$m-thick cylindrical tube of the resin PFA is covered. The material PFA is used as a conventional material.

For comparison, an explanation will be made below about the case where a "solid" image is fixed with the use of the conventional fixing roller and the fixing roller of the present embodiment.

Although the solid image can be fixed to some extent with the use of the fixing roller whose surface is coated with the fluorine-based coating agent PTFE, streaks appear on the image at a place where a toner deposition amount is as much as about 1.3 mg/cm$^2$.

In the present embodiment, on the other hand, no streak marks appear on the "solid" image even if more toner is deposited on the sheet, so that a better wide margin is obtained.

Figure 3:
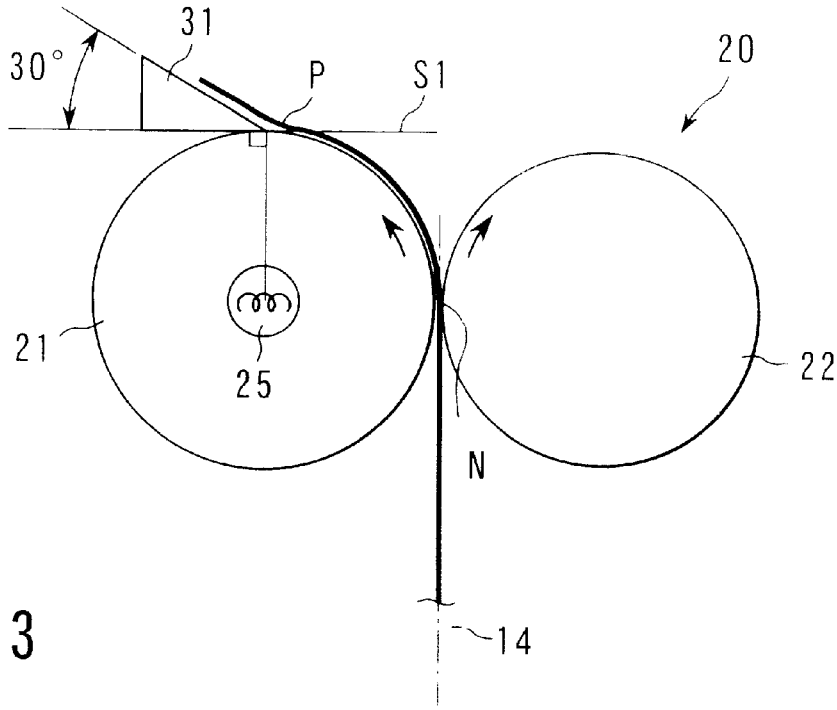
FIG. 3 is a schematic view showing a fixing apparatus according to another embodiment of the present invention.

FIG. 3 shows a second embodiment of the present invention, in which the same reference numerals are employed to designate portions or component parts corresponding to those shown in FIG. 2.

In this embodiment, an angle made by the forward end of the separating claw 31 with respect to a roller tangent line S1 is varied relative to a sheet P. In the case where the separating angle is varied through an angle of over 40°, a sheet jamming is liable to occur. For the case of a type in which the sheet P is fed from below toward an upper side past the fixing nip N, the sheet P is not separated immediately after the passage of the fixing nip N and stays contacted with the fixing roller 21 for a brief time period. If, therefore, the sheet is to be separated at a near-middle portion on the upper surface of the fixing roller 21, when the angle is as abrupt as over 40°, the sheet P strongly abuts against the separating claw 31, thus causing "sheet jamming", sheet creases, etc.

If, on the other hand, the angle of the separating claw 31 is made smaller than 40°, neither the sheet jamming nor the sheet crease, etc., occurs and the angle of below 30° has been found better. If the angle of the separating claw 31 is below 30°, it follows that, within a sheet separable range, a smaller angle is found effective. In this case, use can effectively be made of, as a separating claw, a plate-like member. Thus it is possible to separate the sheet P, with no undue burden on the sheet P, by making the separation angle of the separating claw smaller.

Although, with the fixing roller and pressure applying roller arranged one over the other, it is necessary to abut the separating claw against the sheet, under a predetermined force, with the use of a spring, etc., in which case there is a risk that damage will caused to the surface, etc., of the fixing roller.

According to the present invention, it is possible to abut the sheet against the separating roller 31, under a gravity force, without using any spring, etc., so that less burden is imparted on the fixing roller 21 and no damage is caused to the surface of the fixing roller 21.

Figure 4:
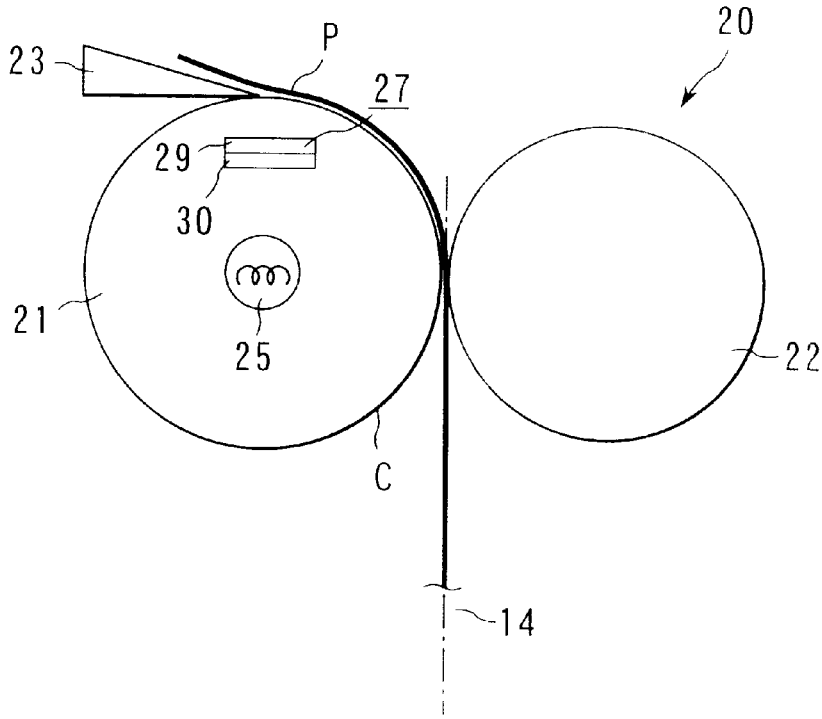
FIG. 4 is a schematic view showing a fixing apparatus according to still another embodiment of the present invention.

FIG. 4 shows a third embodiment of the present invention, in which the same reference numerals are employed to designate a portion or component parts corresponding to those shown in FIG. 2 and a further explanation is, therefore, omitted.

A plate-like shielding member 27 is provided above a heater lamp 25 within a fixing roller 21 such that it is located at a shielding position between the heater lamp 25 and the separating claw 23. The shielding member 27 comprises a base member 29 made of a heat-resistant and heat-shielding material such as asbestos and a reflection plate 30 attached to a lower surface side of the base member 29.

With the use of the fixing apparatus thus constructed, a solid image deposited with a toner of about 1.4 mg/cm$^2$ was fixed to a sheet P and separated from the sheet P.

For comparison, a solid image under a similar condition was fixed to the sheet and separated from a fixing apparatus having no heat shielding member within a fixing roller as in the case of the fixing apparatus of FIG. 1. As a result, the image can be separated according to the Control, but, when a toner deposition amount was 1.5 mg/cm$^2$, a streak mark appeared on the image to some extent due to the use of a conventional separating claw.

In the embodiment shown in FIG. 4, on the other hand, no streak mark appeared on the image due to the use of the separating claw 23 and the image was in a better state and a wide margin of a sheet separation relative to an amount of toner deposited is secured.

Since the heat shielding member 27 itself is located within the fixing roller 21, the shielding member 27 itself is also heated but it is possible to temporarily shield the fixing roller 21 from the heat rays of the heater lamp 25, so that an interface temperature between the toner image and the fixing roller surface at a sheet separating position is somewhat lowered. This is probably what enables sheet separation to being readily effected.

When, on the other hand, measurement was made at a temperature measuring position C shown in FIG. 4, there was no variation in the warming-up time required for the fixing roller 21 to reach the temperature at which it can perform a fixing operation.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing apparatus comprising:

a fixing device having a fixing roller and pressure applying roller set in pressure contact with the fixing roller and, by feeding a developing agent image-transferred medium past a nip located between the fixing roller and the pressure applying roller, fixing the developing agent image to the medium; and a separating device having a forward end set in abutting contact with an outer peripheral surface of the fixing roller and separating the medium which is fed past the nip from the fixing roller, wherein the forward end of the separating device abuts against an outer periphery of the fixing roller at a position of about ¼ of a full outer periphery length of the fixing roller away from a center of the nip along the outer periphery of the fixing roller.

2. A fixing apparatus according to claim 1, wherein the fixing roller and pressure applying roller are arranged in symmetrical relationship to a vertical feeding path and the medium is fed from below, along the vertical feeding path, toward an upper side past the nip.

3. A fixing apparatus according to claim 1, wherein the outer surface of the fixing roller is covered with a fluorine-based material.

4. A fixing apparatus according to claim 1, wherein an abutting angle of the separating device made with respect to the surface of the fixing roller is below 30° relative to a tangent line of the fixing roller.

5. A fixing apparatus according to claim 1, wherein the fixing roller is comprised of a hollow roller in which a heating source and a heat shielding member are provided, the heat shielding member effecting a shielding between the heat source and the forward end of the separating device.

6. An image forming apparatus comprising:

an image carrier for carrying an electrostatic latent image;

an image forming device for forming the electrostatic latent image on the image carrier;

a plurality of developing devices for supplying developing agents of respective colors onto the electrostatic latent image formed on the image carrier to effect color development;

a transferring device for transferring the developing agent image developed by the corresponding developing device;

a fixing device having a fixing roller and a pressure applying roller set in pressure contact with the fixing roller and, by feeding a color developing agent image-transferred medium past a nip located between the fixing roller and the pressure applying roller, fixing the color developing agent image to the medium; and a separating device having a forward and abutting against an outer peripheral surface of the fixing roller to separate the medium which is fed past the nip from the fixing roller, wherein the forward end of the separating device abuts against the outer periphery of the fixing roller at a position of about ¼ of a full outer periphery length of the fixing roller away from a center of the nip along the outer periphery of the fixing roller.

7. An image forming apparatus according to claim 6, wherein the fixing roller and pressure applying roller are arranged in a symmetrical relation to a vertical feeding path and the medium is fed from below, along the vertical feeding path, toward an upper side past the nip.

8. An image forming apparatus according to claim 6, wherein the outer surface of the fixing roller is covered with a fluorine-based material.

9. An image forming apparatus according to claim 6, wherein an abutting angle of the separating device made with respect to the surface of the fixing roller is below 30° relative to a tangent line of the fixing roller.

10. An image forming apparatus according to claim 6, wherein the fixing roller is comprised of a hollow roller in which a heat source and a heat shielding member are provided, the heat shielding member effecting a shielding between the heat source and the forward end of the separating device.

11. A fixing apparatus comprising:

a fixing device having a fixing roller and pressure applying roller set in pressure contact with the fixing roller and, by feeding a developing agent image-transferred medium past a nip located between the fixing roller and the pressure applying roller, fixing the developing agent image to the medium; and a separating device having a forward end set in abutting contact with an outer peripheral surface of the fixing roller and separating the medium which is fed past the nip from the fixing roller, wherein the forward end of the separating device abuts against a portion of an outer periphery of the fixing roller at a position of about ⅛ to ⅓ of a full outer periphery length of the fixing roller away from a center of the nip along the outer periphery of the fixing roller, and wherein the fixing roller comprises a hollow roller, which includes a heating source and a shielding member, the shielding member effecting a shielding between the heat source and the forward end of the separating device.

12. A fixing apparatus according to claim 11, wherein the fixing roller and the pressure applying roller are arranged in a symmetrical relationship to a vertical feeding path and the medium is fed from below, along the vertical feeding path, toward an upper side past the nip.

13. A fixing apparatus according to claim 11, wherein the outer surface of the fixing roller is covered with a fluorine-based material.

14. A fixing apparatus according to claim 11, wherein an abutting angle of the separating device made with respect to the surface of the fixing roller is below 30° relative to a tangent line of the fixing roller.

15. An image forming apparatus comprising:

an image carrier for carrying an electrostatic latent image;

an image forming device for forming the electrostatic latent image on the image carrier;

a plurality of developing devices for supplying developing agents of respective colors onto the electrostatic latent image formed on the image carrier to effect color development;

a transferring device for transferring the developing agent image developed by the corresponding developing device;

a fixing device having a fixing roller and a pressure applying roller set in pressure contact with the fixing roller and, by feeding a color developing agent image-transferred medium past a nip located between the fixing roller and the pressure applying roller, fixing the color developing agent image to the medium; and a separating device having a forward and abutting against an outer peripheral surface of the fixing roller to separate the medium which is fed past the nip from the fixing roller, wherein the forward end of the separating device abuts against a portion of an outer periphery of the fixing roller at a position of about ⅛ to ⅓ of a full outer periphery length of the fixing roller away from a center of the nip along the outer periphery of the fixing roller, and wherein the fixing roller comprises a hollow roller, which includes a heating source and a shielding member, the shielding member effecting a shielding between the heat source and the forward end of the separating device.

16. A fixing apparatus according to claim 15, wherein the fixing roller and the pressure applying roller are arranged in a symmetrical relationship to a vertical feeding path and the medium is fed from below, along the vertical feeding path, toward an upper side past the nip.

17. A fixing apparatus according to claim 15, wherein the outer surface of the fixing roller is covered with a fluorine-based material.

18. A fixing apparatus according to claim 15, wherein an abutting angle of the separating device made with respect to the surface of the fixing roller is below 30° relative to a tangent line of the fixing roller.

* * * * *